US006659584B2

(12) United States Patent
Miura et al.

(10) Patent No.: US 6,659,584 B2
(45) **Date of Patent: *Dec. 9, 2003**

(54) PRINTING APPARATUS AND PRINT METHOD

(75) Inventors: Yasushi Miura, Kawasaki (JP); Hiroyuki Miyake, Kawasaki (JP); Hiroyuki Kuriyama, Kawasaki (JP); Masashi Shimizu, Kawasaki (JP); Chikanobu Ikeda, Tokyo (JP); Shigeru Watanabe, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 39 days.

(21) Appl. No.: 09/215,186

(22) Filed: Dec. 18, 1998

(65) Prior Publication Data

US 2003/0142161 A1 Jul. 31, 2003

(30) Foreign Application Priority Data

Dec. 24, 1997 (JP) ..... 9-355008

(51) Int. Cl.[7] ..... B41J 29/393
(52) U.S. Cl. ..... 347/19; 347/14
(58) Field of Search ..... 347/19, 23, 14, 347/16, 12, 40

(56) References Cited

U.S. PATENT DOCUMENTS

| | | | |
|---|---|---|---|
| 4,313,124 A | 1/1982 | Hara | 346/140 R |
| 4,345,262 A | 8/1982 | Shirato et al. | 346/140 R |
| 4,459,600 A | 7/1984 | Sato et al. | 346/140 R |

(List continued on next page.)

FOREIGN PATENT DOCUMENTS

| | | | |
|---|---|---|---|
| EP | 0 500 281 | 8/1992 | |
| EP | 0 559 370 | 9/1993 | |
| EP | 0 694 396 | 1/1996 | |
| EP | 0 744 295 | 11/1996 | |
| EP | 774295 | * 11/1996 | |
| EP | 0 749 842 | 12/1996 | |
| EP | 0 752 316 | 1/1997 | |
| EP | 0 783 973 | 7/1997 | |
| JP | 54-56847 | 5/1979 | B41M/5/26 |
| JP | 59-123670 | 7/1984 | B41J/3/04 |
| JP | 59-138461 | 8/1984 | B41J/3/04 |
| JP | 60-71260 | 4/1985 | B41J/3/04 |

(List continued on next page.)

OTHER PUBLICATIONS

Office Action dated Jul. 5, 2002 in Japanese Patent Application No. 9–355008.

*Primary Examiner*—Stephen D. Meier
*Assistant Examiner*—Ly T Tran
(74) *Attorney, Agent, or Firm*—Fitzpatrick, Cella, Harper & Scinto

(57) ABSTRACT

A printing apparatus and a print control method which detect a defective printing element in operation failure status while reciprocate-scanning a printhead, and perform appropriate print control such as complementary printing on an unprinted portion by the defective printing element, without reducing the printing speed. An apparatus, to which the method is applied, has a photosensor 8, to detect ink discharge statuses of a plurality of nozzles of a printhead 5, which is provided between a home position of the printhead and the outside of an effective printing area where image printing is to be made. While the printhead 5 is scanned, test ink discharge is performed at the position of the photosensor 8, and the ink discharge statuses of the nozzles are detected by the photosensor 8. A corrector 123 analyzes the operation statuses of the nozzles of the printhead 5 based on the results of detection in a real time manner. A CPU 25 performs print control based on the results of analysis.

17 Claims, 13 Drawing Sheets

U.S. PATENT DOCUMENTS

| | | | | | |
|---|---|---|---|---|---|
| 4,463,359 | A | | 7/1984 | Ayata et al. | 346/1.1 |
| 4,558,333 | A | | 12/1985 | Sugitani et al. | 346/140 R |
| 4,723,129 | A | | 2/1988 | Endo et al. | 346/1.1 |
| 4,740,796 | A | | 4/1988 | Endo et al. | 346/1.1 |
| 5,434,602 | A | * | 7/1995 | Kaburagi et al. | 346/139 |
| 6,010,205 | A | * | 1/2000 | Billet | 347/40 |
| 6,056,387 | A | * | 5/2000 | Kaneko | 347/23 |
| 6,174,039 | B1 | * | 1/2001 | Miyake et al. | 347/12 |
| 6,181,098 | B1 | * | 1/2001 | Murakami | 318/603 |

FOREIGN PATENT DOCUMENTS

| | | | |
|---|---|---|---|
| JP | 60-240460 | 11/1985 | |
| JP | 6-79956 | 3/1994 | |
| JP | 7-25017 | 1/1995 | |
| JP | 7-47684 | 2/1995 | |
| JP | 7-314784 | 12/1995 | |
| JP | 8-25700 | 1/1996 | B41J/2/51 |
| JP | 8-295028 | 11/1996 | |
| JP | 9-94948 | 4/1997 | |
| JP | 9-98244 | 4/1997 | |

* cited by examiner

PRINTING APPARATUS AND PRINT METHOD

BACKGROUND OF THE INVENTION

This invention relates to a printing apparatus and a print method, and more particularly, to a printing apparatus having a printhead with a plurality of nozzles to perform printing in accordance with an ink-jet method, and a print method for the apparatus.

A printing apparatus based on the ink-jet method forms an image by directly discharging ink droplets onto a print medium. In an apparatus according to this method, as the number of constituent members used from image input to image formation is less than that required in the electrophotographic printing method or the like, a desired image can be obtained in a stable manner.

However, since the ink-jet method performs printing by discharging very small ink droplets from fine ink-discharge nozzles provided in a printhead, ink discharge failure may occur due to various reasons. For example, (1) if the nozzle is clogged with dust, it does not discharge ink; (2) if print operation is not performed and the printhead is not used for a long period, the volatile component of ink evaporates and the ink viscosity increases, then the nozzle is clogged with the ink, which disturbs ink discharge; (3) if disconnection occurs at a part of heaters, integrated in a high density for film boiling to cause ink discharge, ink discharge fails since heating cannot be made; (4) if a part of ink droplet discharged from an ink discharge orifice may adhere to the discharge orifice and cover the orifice, it disturbs ink discharge. As a result, a white line due to the ink discharge failure occurs in a printed image, which degrades the image quality.

As for this drawback, if the number of nozzles of the printhead is increased to several hundreds or several thousands so as to improve the printing speed, the probability of nozzles in ink-discharge failure status increases in proportion to the increase in the number of the nozzles. Accordingly, this drawback becomes a more serious problem from the viewpoint of quality of printed image.

On the other hand, from the viewpoint of manufacture of printhead, it is necessary to manufacture a faultless printhead which can normally discharge ink from all the nozzles. However, if the number of nozzles is increased to several hundreds or several thousands, the probability of defective nozzles in one printhead increases in proportion to the increase in the number of nozzles, which reduces the yield. That is, there is a problem in the manufacture of printhead to satisfy the economical requirement. Further, even though a faultless printhead can be manufactured, if one of the nozzles has a trouble while the printhead is used, the entire printhead cannot be used.

For example, in a printing apparatus using about four to eight printheads, each having several thousands of nozzles, corresponding to ink colors for full-color printing, it is frequent that some nozzle abnormally operates. Each time abnormal operation occurs at some nozzle, a poor quality image is formed. Such printing apparatus cannot be put into practical use.

To solve these problems, conventionally, various improvements have been made.

For example, a printing method as follows has been proposed to attain excellent image quality even if a nozzle becomes a defective one which does not discharge ink. That is, prior to one print-scanning of the printhead, the defective nozzle is detected, then image data corresponding to the nozzle is removed, and printing is performed in forward-scanning of the printhead. As an image portion corresponding to the defective nozzle is not printed in this printing, a white line remains in the printed image. Next, in backward scanning of the printhead, the printhead is shifted in a print-medium feeding direction for one to several nozzles, or the print medium is conveyed in the print-medium feeding direction such that a normal nozzle is positioned opposite to the white line. Then, the previously-removed image data is sent in an order reversed to that in the forward scanning, and ink discharge is performed by using the normal nozzle. Thus, complementary printing is performed as disclosed in Japanese Patent Application Laid-Open No. 8-25700.

In addition, a particular method to detect a defective nozzle has been proposed as follows. That is, a print medium for detecting ink-discharge status is provided outside an effective printing area by the printhead, and a predetermined pattern is printed while the print medium is conveyed in a print-medium feeding direction at a wide pitch so as to detect a defective nozzle. Next, the printhead is moved away from the printing position, then, an optical reader having a high-resolution CCD camera is moved to the position to read the pattern. Then, a defective nozzle which does not discharge ink is determined based on the read pattern.

Further, it has been also proposed to move the print medium with the printed pattern to the position of the optical reader, and read the pattern at the position by the optical reader.

Further, it has been also proposed to print a pattern on a medium such as a glass disk, then rotate the disk so as to move the pattern to a reading position of an optical reader, and read the pattern by the optical reader.

By adopting these methods, excellent printed images can be obtained.

However, in the above-described methods, the defective nozzle detection cannot be made unless the optical reader is moved to the position where the pattern has been printed or the print medium where the pattern has been printed is moved to the position where the optical reader is situated.

Then, a method for detecting a defective nozzle without moving the optical reader or print medium has been proposed. According to this method, an image forming apparatus may be constructed such that the printhead is stopped at a predetermined position where ink discharged from the printhead can block a light beam from an optical sensor, then ink is discharged to block the light beam, and a defective nozzle is detected from output from the optical sensor. In case of color printer, as a plurality of printheads corresponding to the number of ink colors are mounted, the printheads are sequentially stopped at the predetermined position with high precision for ink discharge.

However, the above-described conventional techniques require a particular operation for detecting a defective nozzle, which greatly reduces the printing speed.

For this reason, it has been proposed not to perform complementary printing but to perform printing using a currently-used printhead during the defective nozzle detection, and to perform the complementary printing after a defective nozzle has been detected. Although this method prevents the reduction of printing speed, it cannot avoid poor quality printing, since it does not perform the complementary printing during the defective nozzle detection.

SUMMARY OF THE INVENTION

Accordingly, it is an object of the present invention to provide a printing apparatus and a print method which perform appropriate print control such as complementary printing for printing failure caused by a defective printing element in operation failure status, without reducing a printing speed, by detecting the defective printing element in a realtime manner while reciprocate-scanning a printhead.

According to one aspect of the present invention, the foregoing object is attained by providing a printing apparatus which performs printing by discharging ink onto a print medium while reciprocate-scanning a printhead based on an ink-jet method, having a plurality of printing elements, the apparatus comprising: scan means for reciprocate-scanning the printhead; detection means, provided in a scanning path of the printhead, for detecting ink discharge statuses of the plurality of printing elements of the printhead; test discharge means for controlling operation of the printhead to perform test ink discharge at a position where the detection means is provided, while the scan means reciprocate-scans the printhead; analysis means for detecting ink, discharged by the test discharge means, by using the detection means, and analyzing discharge statuses of the plurality of printing elements of the printhead; and control means for performing print control based on the results of analysis by the analysis means.

Note that the plurality of printing elements of the printhead is arrayed in one line.

Also note that the detection means may be provided at one end of the scanning path of the printhead, or it may be provided outside an area occupied by the printing medium in the scanning path of the printhead.

It is preferable that the detection means includes light emission means for emitting a light beam and photoreception means for receiving the light beam, and the printhead is provided such that ink droplets discharged from the plurality of printing elements block the light beam. Further, it is preferable that the light emission means and the photoreception means are provided such that a light axis of the light intersects an array direction of the plurality of printing elements of the printhead. Further, it is more preferable that the printing apparatus further comprises a slit for limiting a light flux of the light beam entering the photoreception means, in front of the photoreception means.

Further, it is preferable that the printing apparatus further comprises recovery means for performing recovery operation on the printhead, and print means for performing print operation by driving the printhead upon forward scanning of the printhead by the scan means. Further, it is preferable that the printing apparatus comprises specification means for specifying a printing element in discharge failure status among the plurality of printing elements of the printhead, based on the results of analysis by the analysis means; and complementary printing means for performing complementary printing on a printed result by the printing element in the discharge failure status specified by the specification means, by using a printing element which normally operates, upon backward scanning of the printhead.

By the above construction, the control means drives the recovery means based on the results of analysis.

Further, it may be arranged such that the printing apparatus further comprises display means for displaying a message, and if the printing element in the discharge failure status is not recovered from that status even when the control means has driven the recovery means to perform the recovery operation on the printing element a predetermined number of times, the control means displays a message advising a user to change the printhead on the display means. Further, the control means operates the specification means and the complementary printing means based on the results of analysis by the analysis means.

Further, it may be arranged such that the printing apparatus further comprises encoder means for detecting a position of the printhead on the scanning path by the scan means, and ink discharge timing by the test discharge means is based on position information outputted from the encoder means. Further, each of the plurality of printing elements is specified by synchronizing the ink discharge timing with an output signal from the detection means.

Note that it is preferable that the printhead has electrothermal transducers for generating thermal energy to be provided to ink, so as to discharge the ink by utilizing the thermal energy.

According to another aspect of the present invention, the foregoing object is attained by providing a printing method of printing by reciprocally scanning a printhead which has a plurality of printing elements and discharges ink on a printing medium, comprising the steps of: starting to scan the printhead in a predetermined direction; test-discharging ink to a detection unit provided in a scanning path of the printhead; detecting an ink droplet test-discharged by the detection unit; and controlling a print operation during a period of scanning the printhead, based on a detection result in the detecting step, wherein the detecting step detects as to whether or not an ink droplet has been detected, corresponding to each of the plurality of printing elements.

Note that the controlling step performs control such that the printhead prints on the printing medium when scanning the printhead in the predetermined direction, while the printhead complementarily prints on a position, where a printing element was supposed to discharge an ink droplet but it is detected based on the detection result that the printing element did not discharge, of the print medium when scanning the printhead in a direction opposite to the predetermined direction.

In accordance with the present invention as described above, the printing apparatus comprises the detection means, provided at one end of the scanning path of the printhead, for detecting ink discharge statuses of the respective printing elements of the printhead. The apparatus operates the printhead to perform test ink discharge at a position where the detection means is provided while the printhead is scanned, detects the discharged ink by the detection means, analyzes the operation statuses of the respective printing elements of the printhead, and performs print control based on the result of analysis.

The present invention is particularly advantageous since the statuses of the respective printing elements of the printhead can be detected without stopping the printhead or reducing the printing speed.

Accordingly, if a defective printing element in the operation failure status is detected, the printing apparatus performs appropriate print control such as recovery operation or complementary printing.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENT

A preferred embodiment of the present invention will now be described in detail in accordance with the accompanying drawings.

Figure 1:
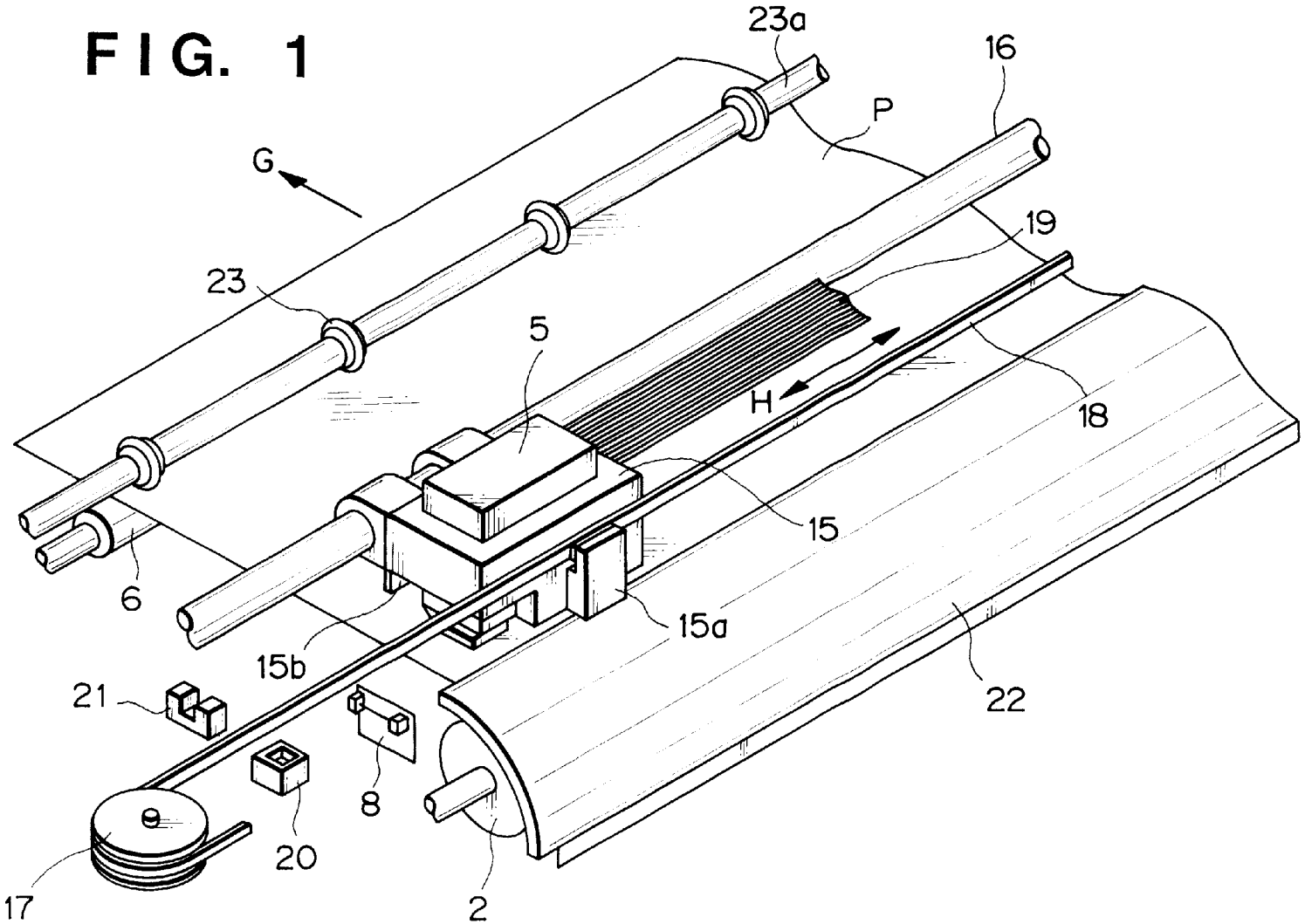
FIG. 1 is a perspective view showing the detailed structure of a printer having a printhead to perform printing in accordance with the ink-jet method, as a typical embodiment of the present invention.

FIG. 1 is a perspective view showing the detailed structure of a printer having a printhead to perform printing in accordance with the ink-jet method, as a typical embodiment of the present invention.

As shown in FIG. 1, a printhead 5, including an ink tank, is a cartridge type printhead which can be exchanged for a new printhead when ink is exhausted.

In FIG. 1, a carriage 15 is reciprocate-scanned in a direction (main-scanning direction represented by the arrow H) orthogonal to a feeding direction (subscanning direction represented by the arrow G) of a print sheet P, while holding the printhead 5 with high precision. The carriage 15 is slidably held between a guide shaft 16 and a thrust member 15*a*. The reciprocation scanning of the carriage 15 is made by a pulley 17 driven by a carriage motor (not shown) and a timing belt 18, and a print signal and electric power, provided to the printhead 5 at this time, are supplied from electric circuits of the apparatus main body via a flexible cable 19. The printhead 5 and the flexible cable 19 are connected by press-contact between their respective contact points.

Further, a cap 20 is provided at a home position of the carriage 15. The cap 20 also functions as an ink reception member. The cap 20 moves upward/downward in accordance with necessity. When the cap 20 moves upward, it comes into close contact with the printhead 5 so as to cover a nozzle portion, preventing evaporation of ink and adhesion of dust to the nozzles.

The apparatus uses a carriage home sensor 21 provided in the apparatus main body and a light shield plate 15*b* provided in the carriage 15 so as to set the printhead 5 and the cap 20 at positions relatively opposite to each other. The carriage home sensor 21 uses a photo-interrupter. The carriage home sensor 21 detects that the printhead 5 and the cap 20 are at relatively opposite positions by utilizing the fact that when the carriage 15 moves to a standby position, light emitted from a part of the carriage home sensor 21 is blocked by the light shield plate 15*b*.

The print sheet P is conveyed upward from the lower side in FIG. 1, then turned in a horizontal direction by a paper feed roller 2 and a paper guide 22, and conveyed in the subscanning direction (the arrow G direction). The paper feed roller 2 and a paper discharge roller 6 are respectively driven by a printing motor (not shown), to convey the print sheet P with high precision in the subscanning direction, in cooperation with the reciprocation scanning of the carriage 15, in accordance with necessity. Further, spurs 23 of highly water-repellent material, each having a toothed circumferential edge to contact the print sheet P only by this portion, are provided in the subscanning direction. The spurs 23 are provided at a plurality of positions opposite to the paper discharge roller 6, at predetermined intervals in the main-scanning direction, on a bearing member 23*a*. Even if the spurs 23 come into contact with an unfixed image on the print sheet P immediately after printing, the spurs 23 guide and convey the print sheet P without influencing the image.

Figure 2:
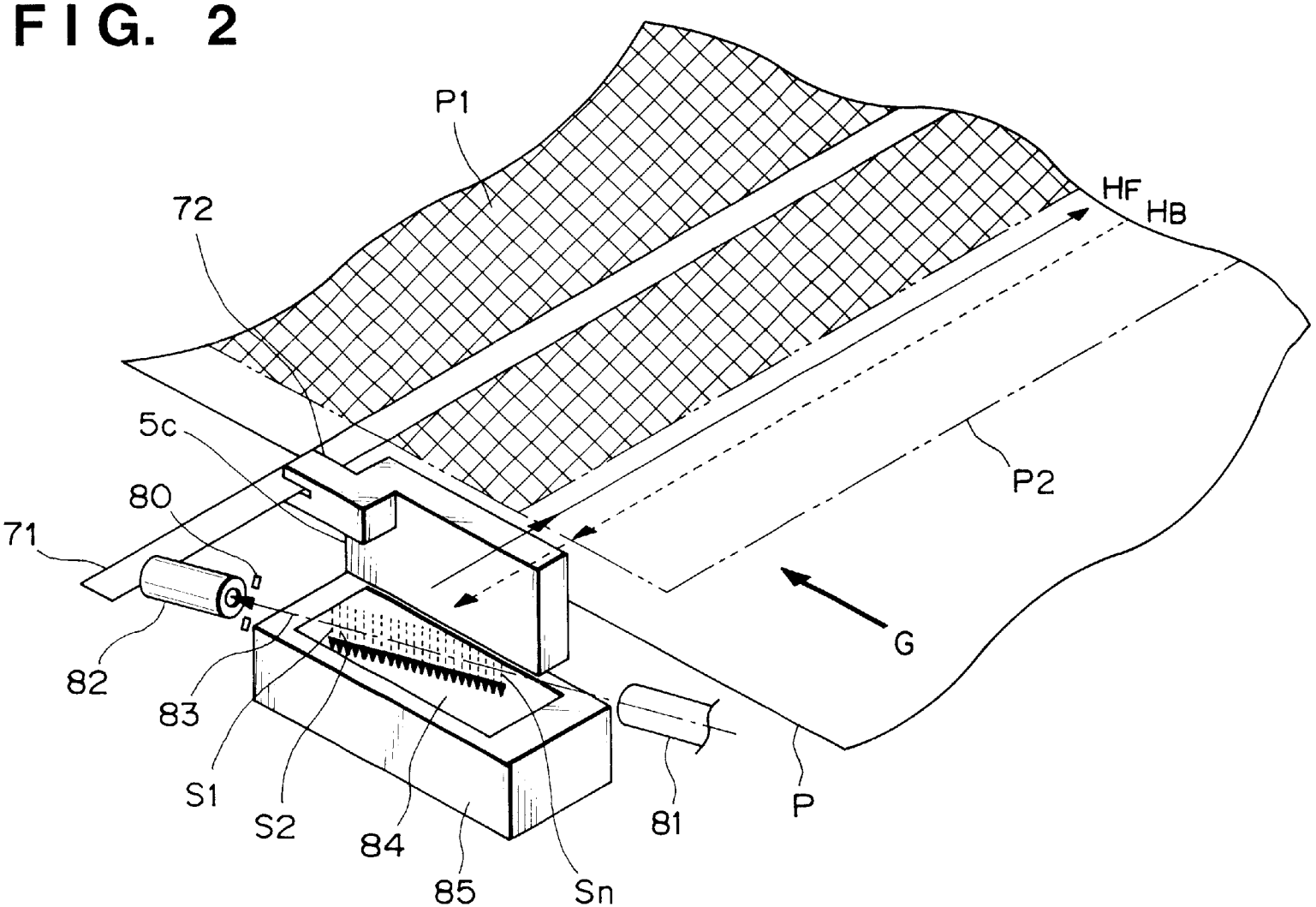
FIG. 2 is an enlarged perspective view showing the detailed structure around a photosensor 8 of the printer in FIG. 1.

As shown in FIG. 2, the photosensor 8 is provided between the cap 20 and the end of the print sheet P at a position opposite to a nozzle array 5*c* of the printhead 5. The photosensor 8 is a photo-interrupter sensor which optically and directly detects ink droplets discharged from the nozzles of the printhead 5.

FIG. 2 is an enlarged perspective view showing the detailed structure around the photosensor 8 of the printer in FIG. 1.

The photosensor 8 uses an infrared LED as an light emitting device 81. The light emitting device 81 has an LED light emitting surface integrally formed with a lens, and it projects a light beam toward a photoreception device 82. The photoreception device 82 comprises a photo-transistor, and it has a hole of, e.g., about 0.7 mm×0.7 mm, formed by a molded member 80, in front of the photoreception surface, on its optical axis, to limit the detection range within the entire region between the photoreception device 81 and the light emitting device 82 to 0.7 mm in the height direction and 0.7 mm in the width direction.

Since the size of the ink droplet is equal to or less than 1/10 of the diameter of the light flux of the light beam and the diameter of the sensor, and the change amount in the quantity of light obtained by the sensor is small, the detection range is limited by the pin hole formed by the molded member 80, so that the ratio (S/N ratio) between the quantity of light obtained when the ink droplet exists within the range and that obtained when no ink droplet exists in the light flux can be increased, and detection precision can be increased.

Further, a light axis 83 connecting the light emitting device 81 to the photoreception device 82 is arranged so as to intersect the nozzle array 5*c* of the printhead 5 at an angle θ, and the interval between the light emitting device 81 and the photoreception device 82 is wider than the length of the nozzle array 5*c* of the printhead 5. When an ink droplet passes through the detection range, the ink droplet blocks light from the light emitting side, thus reduces the quantity of light to the photoreception side, which changes output from the phototransistor as the photoreception device 82.

Note that the means for limiting the detection range and the shape of the means are not necessarily the pin hole of molded member, but a slit or the like may be used.

The printer performs normal printing when the printhead moves in a forward direction represented by the arrow $H_F$, in the reciprocation scanning of the printhead, and when the printhead moves in a backward direction represented by the arrow $H_B$, performs complementary printing to complement an unprinted image portion caused by a defective nozzle.

In FIG. 2, reference numeral P1 denotes an area where printing has been already performed; P2, an area where printing is to be performed; S1, S2 and Sn, falling trajectory of ink droplets discharged from the printhead; 71, a scale attached in parallel to a moving direction of the printhead 5; and 72, a linear encoder attached to the printhead 5.

The linear encoder 72 detects the position of the printhead 5 by reading a graduation line of the scale 71 while the printhead 5 moves. The detected position is utilized as a reference for image printing and as reference information for defective nozzle detection to be described later.

Further, a member 84, which receives ink droplets discharged for the defective nozzle detection, is attached to a support base 85. Although not shown, small amount of cleaning water is intermittently poured into the member 84, and ink is discharged by a suction pump (not shown) with the water.

Note that as the number of nozzles of the printhead increases, ink droplets must be detected in a stable manner for a long period. Accordingly, it is advantageous that the light source of the photosensor has a high directionality to easily limit the light flux. Accordingly, in addition to the above-described infrared light from the LED, semiconductor laser or other laser light sources may be used. Further, ink droplets are sequentially discharged from the printhead, in one-nozzle units, at short discharge periods of 200 $\mu$m or less. Accordingly, it is preferable that the photosensor 8 is a high-speed response device such as a PIN silicon photodiode. Further, the output from the light source may be controlled in correspondence with the characteristic (e.g., the absolute rating of incident light intensity) of the photosensor 8. For example, the quantity of light from the light source may be controlled by using an ND filter or the like.

Figure 3A:
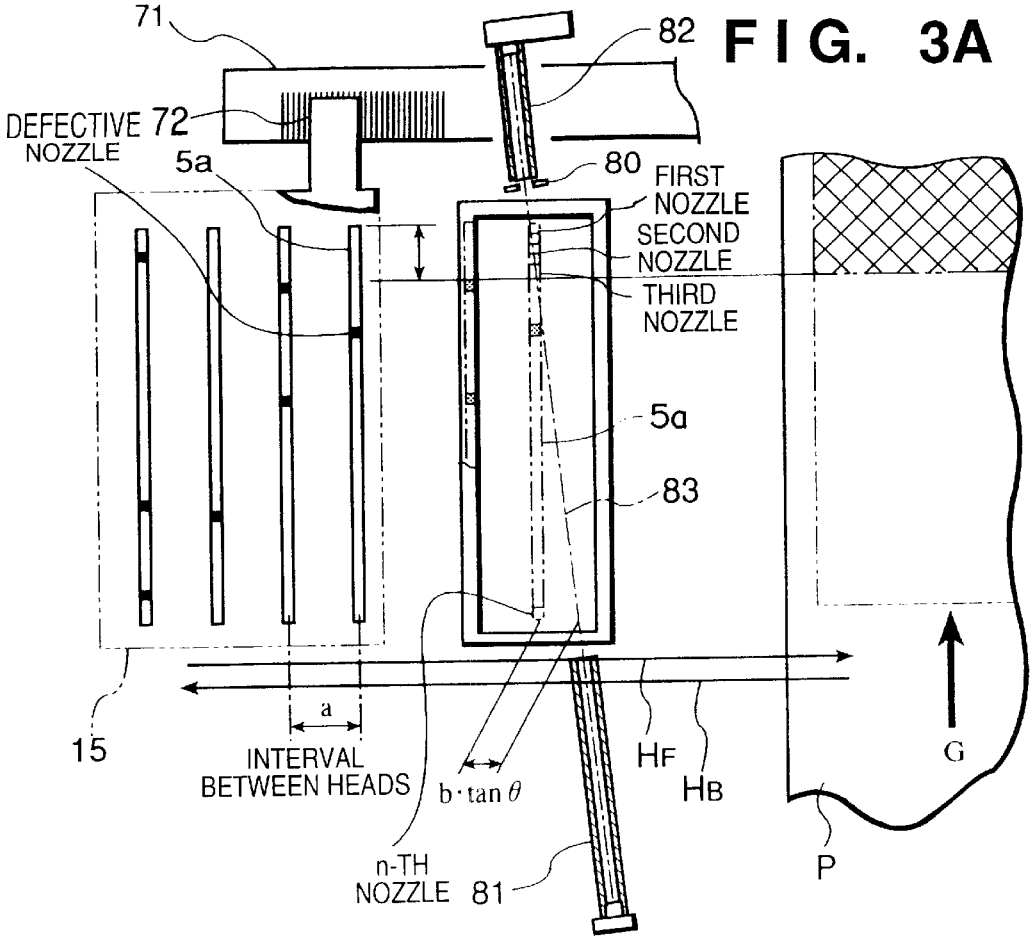
FIGS. 3A and 3B are explanatory views showing the positional relation between a nozzle array of a printhead 5 and the photosensor 8.
Figure 3B:
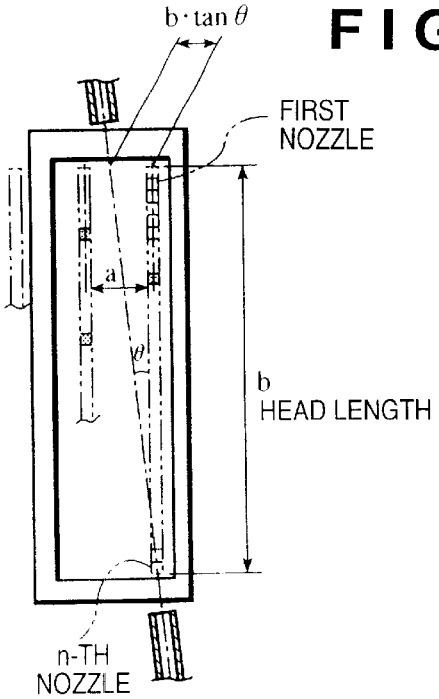

FIGS. 3A and 3B are explanatory views showing the positional relation between the nozzle array of the printhead 5 and the photosensor 8. For example, as shown in FIG. 3A, in a case where four nozzle arrays, corresponding to cyan, magenta, yellow and black are provided in parallel to discharge the four color ink from the printhead 5 as a color printhead, to avoid interference by photosensor output signals obtained from the adjacent nozzle arrays, the interval (a) between heads, the head length (b) (effective printing length), and the angle (θ) between the axis of light beam and the nozzle array must satisfy the following relation:

$$b \times \tan\theta < a$$

If the above relation is not satisfied, before defective nozzle detection with respect to one nozzle array is completed, ink droplets discharged from the next nozzle array pass the light, whereby the correspondence between the defective nozzle determination and nozzle array of interest cannot be discriminated.

In the present embodiment, as the nozzle arrays are slanted at the angle θ to the light axis of the photosensor, the photosensor can detect the discharge status of each nozzle. Further, even in case of a color printhead having a plurality of nozzle arrays, since the interval between nozzles is determined in consideration of the angle (θ), the photosensor can detect the ink discharge status of each nozzle of each nozzle array.

Figure 4:
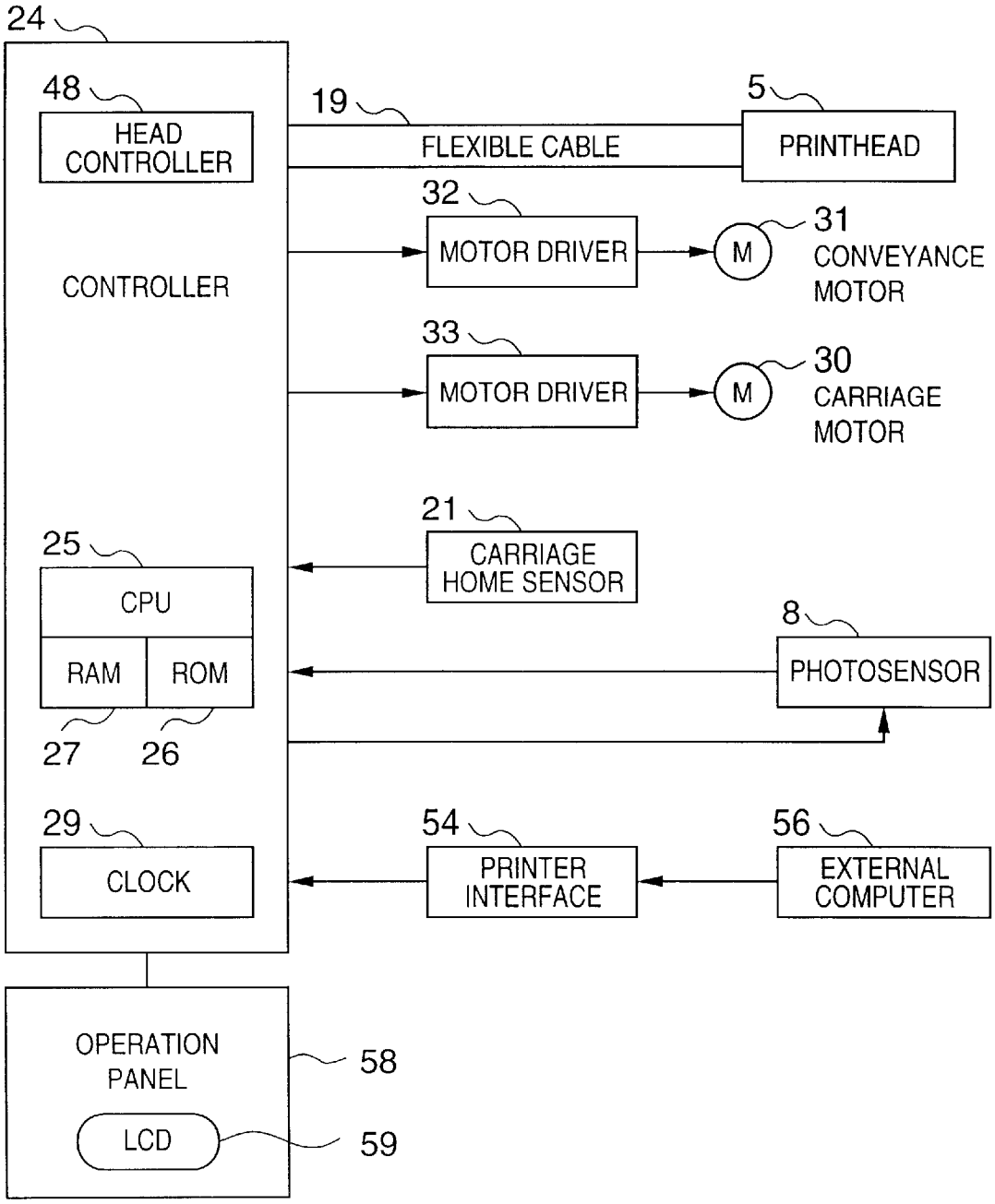
FIG. 4 is a block diagram showing the control construction of the printer in FIG. 1.

FIG. 4 is a block diagram showing the control construction of the printer in FIG. 1.

In FIG. 4, numeral 24 denotes a controller for controlling the overall apparatus. The controller 24 has a CPU 25, a ROM 26 in which a control program executed by the CPU 25 and various data are stored, a RAM 27 used by the CPU 25 as a work area for executing various processings or used for temporarily storing various data, a head controller 48 for controlling the print operation of the printhead 5, and the like.

As shown in FIG. 4, the printhead 5 is connected to the controller 24 via the flexible cable 19. The flexible cable 19 includes a control signal line for the controller 24 to control the printhead 5, and an image signal line. Further, the output from the photosensor 8 is transferred to the controller 24, and analyzed by the CPU 25 via the head controller 48. A carriage motor 30 rotates in accordance with the number of pulse steps by a motor driver 32. Further, the controller 24 controls the carriage motor 30 via a motor driver 33, and controls a conveyance motor 31 via the motor driver 32, further, inputs the output from the carriage home sensor 21.

Further, the controller 24 has a printer interface 54 which receives a print instruction and print data from an external computer 56. Further, the controller 24 is connected to an operation panel 58 for a user of the apparatus to perform various operations and instructions. The operation panel 58 has an LCD 59 to display a message.

Figure 5:
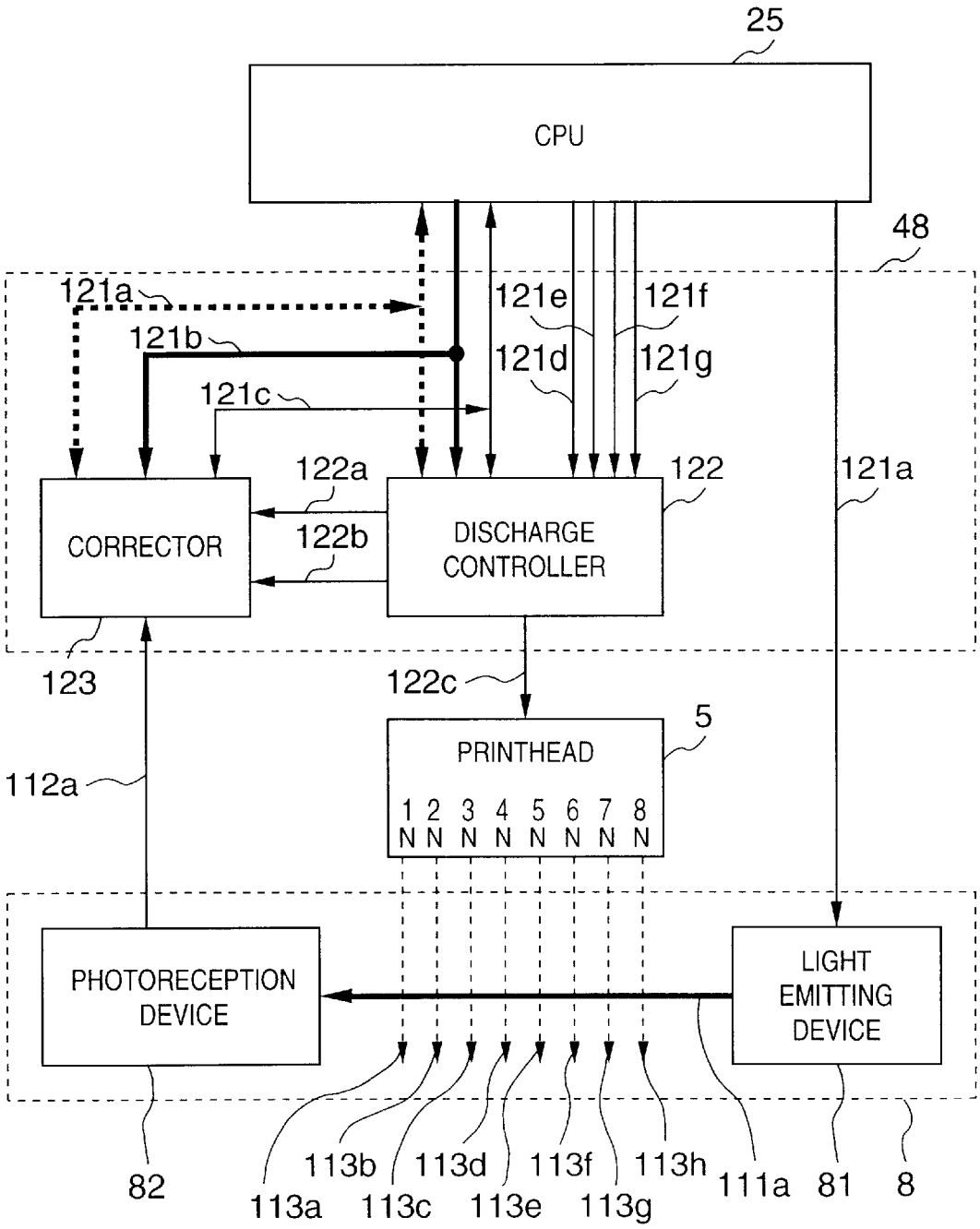
FIG. 5 is a block diagram showing the construction of a head controller 48 and the construction of the photosensor 8 relating to the operation of the head controller 48.

FIG. 5 is a block diagram showing the construction of the head controller 48 and the construction of the photosensor 8 relating to the operation of the head controller 48.

As shown in FIG. 5, the head controller 48 comprises a discharge controller 122 and a corrector 123.

The CPU 25 sequentially transfers image data, sent from the external computer 56 and temporarily stored in the RAM 27 or prepared in the ROM 26 in advance, to the discharge controller 122, in accordance with the print operation control of the printer. The transfer signal includes a BVE* signal (121*d*) indicating an effective image area in the scanning direction of the printhead 5 which performs printing by a serial-scan method, a VE* signal (121*e*) indicating an effective image area in the direction along the nozzle array 5*a* of the printhead 5, an image signal (121*f*), and a transfer synchronizing clock (121*g*) for the image signal 121*f*. These four signals are generally referred to as an image control signal. The image control signal is generated based on a reference signal from the linear encoder 72 that monitors the position of the printhead 5, and used for controlling correspondence between data and its print position.

Further, the discharge controller 122 and the corrector 123 are interconnected and connected to the CPU 25 via a CPU data bus 121*a*, a CPU address bus 121*b* and a CPU control bus 121*c*. Bus control signals transmitted/received via the CPU control bus 121*c* include a device chip select signal, bus read/write signals, a bus direction signal and the like. Note that the CPU data bus 121*a*, the CPU address bus 121*b* and the CPU control bus 121*c* may be generally referred to as a CPU bus.

Further, the CPU 25 outputs a light-emission control signal 121*a* to the light emitting device 81 of the photosensor 8 so as to turn the light source ON/OFF.

The discharge controller 122 generates a head control signal (122*c*) consisting of four types of signals necessary for operating the printhead 5, in accordance with image control signals (121*d* to 121*g*) supplied from the CPU 25 via the CPU bus. Further, the discharge controller 122 outputs a correction synchronizing clock (122*a*) and a discharge synchronizing signal (122*b*) synchronized with the VE* signal (121*e*), to the corrector 123.

The corrector 123 receives a detection signal 112*a* outputted from the photoreception device 82, then increases the S/N ratio, then detects the ink discharge status of the nozzles of the printhead 5 with high precision, in synchronization with the correction synchronizing clock 122*a* and the discharge synchronizing signal 122*b* supplied from the discharge controller 122, and transfers detection data to the CPU 25 via the CPU bus, in accordance with access timing from the CPU 25.

A light beam emitted from the light emitting device 81 toward the photoreception device 82 is blocked by ink droplets (113*a* to 113*h*) sequentially discharged from the nozzles (1N to 8N in FIG. 5) of the printhead 5. The light blocking is detected by the reduction of intensity of received light at the photoreception device 82, and the ink discharge statuses of the respective nozzles are determined based on information obtained from the detection.

Figure 6:
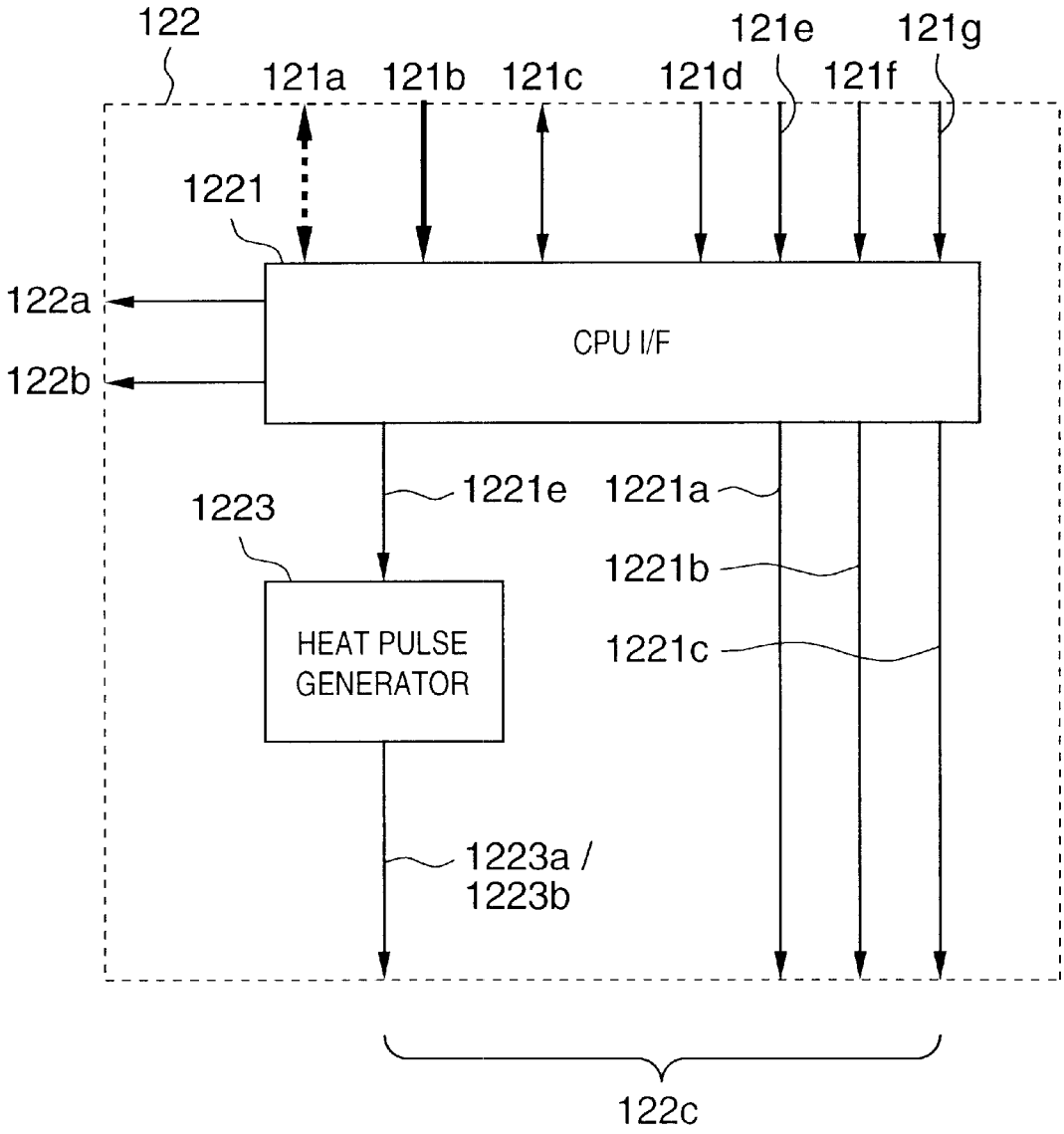
FIG. 6 is a block diagram showing the construction of a discharge controller 122.

FIG. 6 is a block diagram showing the internal construction of the discharge controller 122.

As shown in FIG. 6, the discharge controller 122 comprises a CPU interface (I/F) 1221 and a heat pulse generator 1223. The heat pulse generator 1223 generates a control signal used by the printhead 5 upon printing using image data. On the other hand, the CPU interface 1221, connected to the CPU 25 via the CPU bus, performs settings necessary for discharge controls (1) to (4) to be described later, generates an image transfer signal supplied to the printhead 5, and generates a control signal supplied to the corrector 123.

The settings necessary for discharge controls and signal generation are as follows.

(1) Setting of Heat Pulse to Heat Pulse Generator (1223)

A double pulse as the heat pulse upon execution of normal print operation is set by a setting signal (1221*e*). The set heat pulse width is a pulse width in a discharge enable area.

(2) Generation of Data Transfer Signal (1221*a* to 1221*c*) to Printhead 5 Based on Image Control Signal (121*d* to 121*g*) Supplied from CPU 25

The data transfer signal 1221*a* is an image signal corresponding to all the nozzles (for 8 nozzles in FIG. 5); the data transfer signal 1221*b*, a synchronizing clock; and the data transfer signal 1221*c*, a latch signal. More specifically, the signals are generated such that the image signal 1221*a* is transferred to a shift register (not shown) in the printhead 5, at the rising edge of the synchronizing clock 1221*b*, then the latch signal 1221*c* is transferred to the printhead 5, and the image signal 1221*a* is latched by a latch circuit (not shown) in the printhead 5. Note that actual ink discharge is performed by a discharge pulse signal (1223*a* or 1223*b*) supplied from the heat pulse generator 1223.

(3) Generation of Clock Signal 112*a* Supplied to Corrector 123

This signal is a clock signal, asynchronous with the image transfer clock 1221*b*, having a frequency four times of that of the image transfer clock 1221*b*.

(4) Generation of VE* Signal 122*b* Supplied to Corrector 123

This synchronizing signal, synchronous with the VE* signal (121*e*), is outputted at the same timing as that of the discharge pulse signal.

Figure 7:
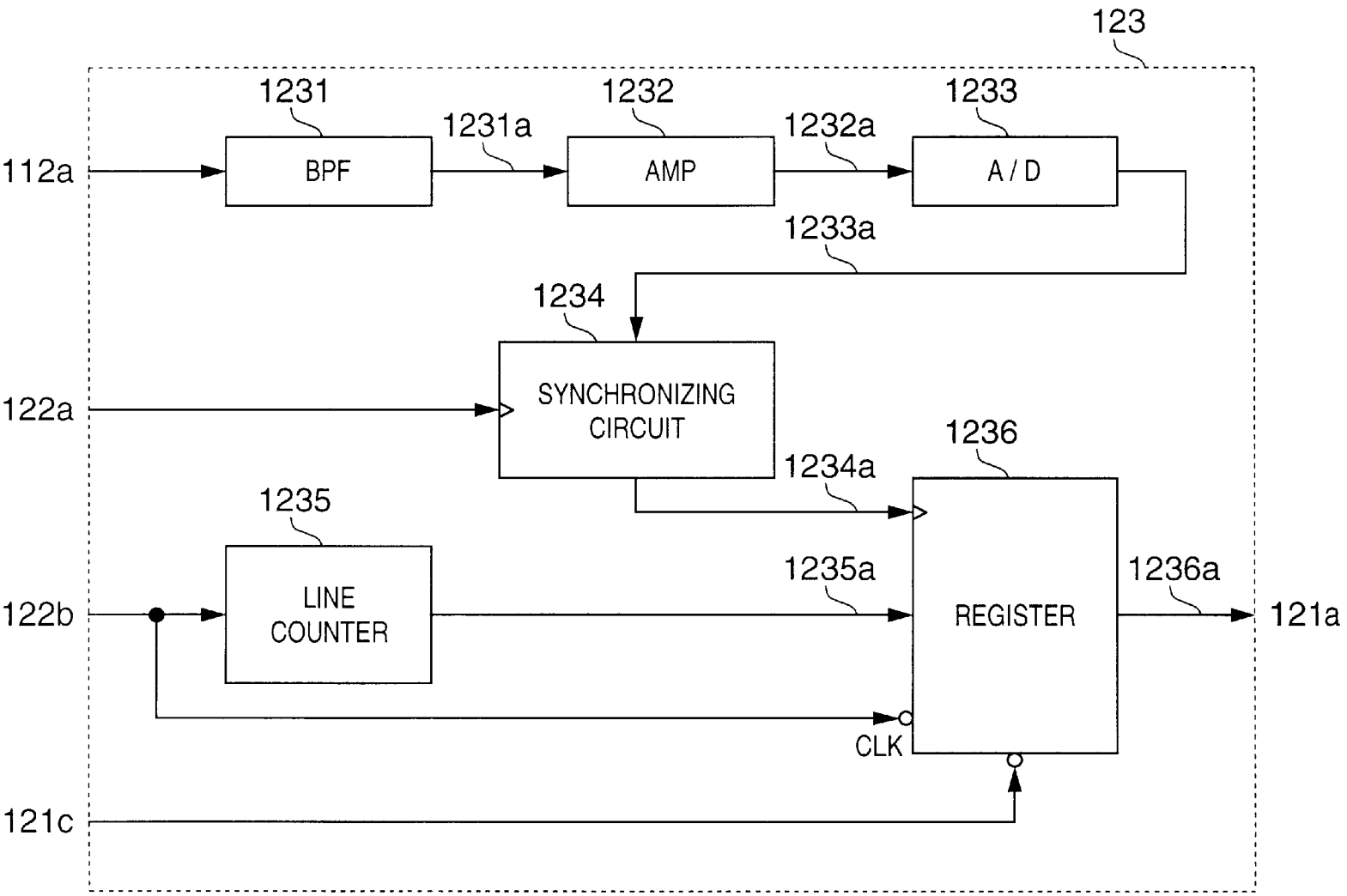
FIG. 7 is a block diagram showing the internal construction of a corrector 123.
Figure 8:
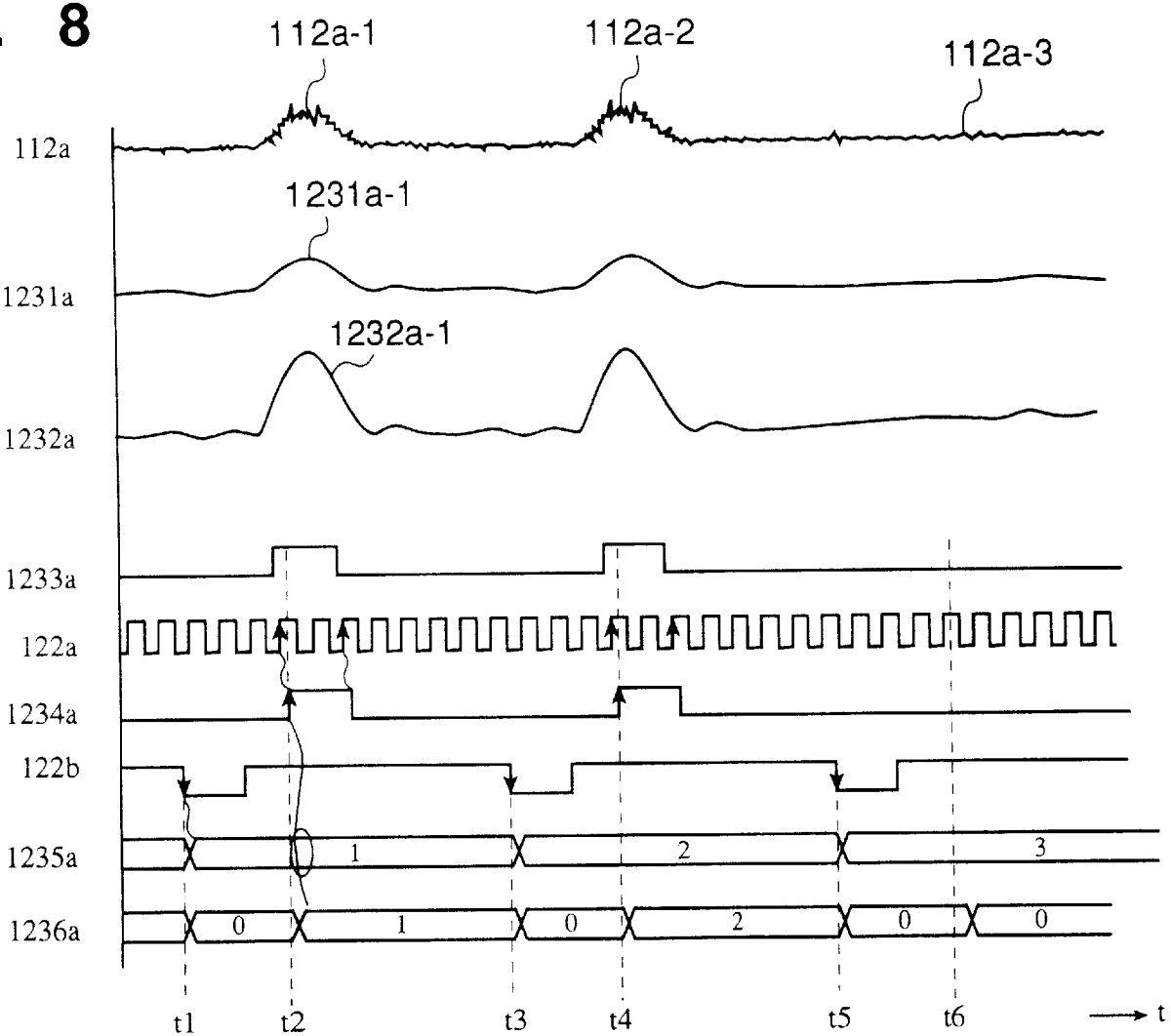
FIG. 8 is a timing chart showing various signal timings when a detection signal obtained from the photosensor 8 is processed by the corrector 123.

FIG. 7 is a block diagram showing the internal construction of the corrector 123. FIG. 8 is a timing chart showing various signal timings when a detection signal obtained from the photosensor 8 is processed by the corrector 123. Hereinbelow, the operation of the corrector 123 will be described with reference to FIGS. 7 and 8.

In FIG. 7, a band-pass filter (BPF) 1231, which is a filter to improve the S/N ratio of the detection signal (112*a*) obtained from the output from the photoreception device 82, extracts a characteristic waveform (1231*a*: hereinafter referred to as a filtered signal) from the detection signal 112*a*. The detection signal 112*a* indicates whether or not ink is normally discharged sequentially from the first nozzle of the pinhead 5. If ink is normally discharged from all the n nozzles of the printhead 5, a signal having peaks at predetermined periods is outputted. In the detection signal 112*a* in FIG. 8, numeral 112*a*-1 denotes a detection signal relating to ink-droplet discharge from the first nozzle; 112*a*-2, a detection signal relating to ink-droplet discharge from the second nozzle; 112*a*-3, a detection signal relating to ink-droplet discharge from the third nozzle. Similarly, detection signals are outputted until a signal corresponding to the n-th nozzle is outputted. Note that FIG. 8 shows the ink discharge statuses of the first to third nozzles. This figure shows statuses indicating that ink is normally discharged from the first and second nozzles (discharge statuses) and a status indicating that ink is not discharged from the third nozzle (discharge failure status).

As shown in FIG. 8, as the detection signal 112*a* includes a noise component, the filtered signal (1231*a*) is generated by removing the noise component through the band-pass filter 1231. By this arrangement, for example, the detection signal 112*a*-1 relating to the ink-droplet discharge from the first nozzle becomes a filtered signal where a high frequency noise component is removed as a signal 1231*a*-1 in FIG. 8.

However, as the extracted characteristic waveform (1231*a*) is a weak signal with a low voltage level, it is not appropriate for the processing by the CPU 25. Accordingly, an amplifier (AMP) 1232 amplifies the filtered signal (1231*a*), and as shown in FIG. 8, the amplifier 1232 outputs the amplified signal (1232*a*). Then, an A/D converter 1233 converts the amplified signal into a digital signal (1233*a*).

The digital detection signal (1233*a*) is inputted into a synchronizing circuit 1234. To remove a noise signal such as spike noise unnecessary for signal processing, the signal is shaped based on the clock signal (122*a*) supplied from the discharge controller 122 as shown in FIG. 8. The shaped detection signal (1234*a*) without noise component is inputted into a latch clock of a register 1236.

On the other hand, a count signal (1235*a*), as output from a line counter 1235 which counts the order of ink discharge, is inputted into the register 1236, and the register 1236 is set to the input value. The set register data is outputted to the CPU 25 via the CPU data bus 121*a*, in accordance with the control signal supplied from the CPU 25 via the CPU control bus 121*c*. The set value of the register 1236 is cleared upon each discharge by a discharge count signal (122*b*).

Accordingly, when an ink droplet is discharged, the register 1236 outputs discharge detection data (1236*a*) indicating a nozzle number, while if ink discharge failure is detected, the register 1236 outputs the discharge detection data (1236*a*) having a value "0".

Next, actual ink droplet detection will be described in order with reference to the timing chart of FIG. 8.

(1) time t=t1

When the discharge count signal (122*b*) is inputted into the line counter 1235, and the count value of the count signal (1235*a*) is incremented to "1". At the same time, the discharge count signal (122*b*) is also inputted into a clear terminal (CLR) of the register 1236, and the value of the discharge detection data (1236*a*) is cleared to "0".

(2) time t=t2

As the rising of the detection signal (1234*a*) indicates that an ink droplet from the first nozzle of the printhead 5 has been detected, the value "1" of the count signal (1235*a*) is latched by the register 1236. The value of the latched discharge detection data (1236*a*) changes from "0" to "1" at this timing, and the detection of ink droplet from the first nozzle is notified via the CPU data bus 121*a* to the CPU 25.

(3) time t=t3

The count value of the line counter 1235 is incremented by the discharge count signal (122*b*), and the value of the count signal 1235*a* is changed to "2". At the same time, the value of the discharge detection data (1236*a*) of the register 1236 is cleared to "0".

(4) time t=t4

As the next rising of the detection signal (1234*a*) indicates that an ink droplet from the second nozzle of the printhead 5 has been detected, the value "2" of the count signal (1235*a*) is latched by the register 1236. The value of the latched discharge detection data (1236*a*) changes from "0" to "2" at this timing, and the detection of ink droplet from the second nozzle is notified via the CPU data bus 121*a* to the CPU 25.

(5) time t=t5

The count value of the line counter 1235 is incremented by the discharge count signal (122*b*), and the value of the count signal (1235*a*) is changed to "3". At the same time, the discharge detection data (1236*a*) of the register 1236 is cleared to "0".

(6) time t=t6

At this timing, the detection signal (1234*a*) does not indicate ink-droplet detection status, and there is no rising edge in the pulse signal. Therefore, the value "3" of the count signal (1235*a*) cannot be latched by the register 1236. Accordingly, the value of the discharge detection data (1236*a*) as latch data is "0" and it does not change. The status where an ink droplet from the third nozzle has not been detected, i.e., discharge failure status is notified via the CPU data bus 121*a* to the CPU 25.

By the processing as described above, the printer of the present embodiment notifies the CPU 25 of ink discharge status of each nozzle in an approximately real time manner. Further, as the photosensor 8 is provided between the home position of the printhead 5 and the effective printing area, it can detect ink discharge status while the printhead is reciprocate-scanned without specific printhead-moving control.

Further, in the present embodiment, to determine whether each nozzle is a normal nozzle or a defective nozzle with higher precision, the output from the photoreception device 82 is compared with the output from the linear encoder 72.

Figure 9:
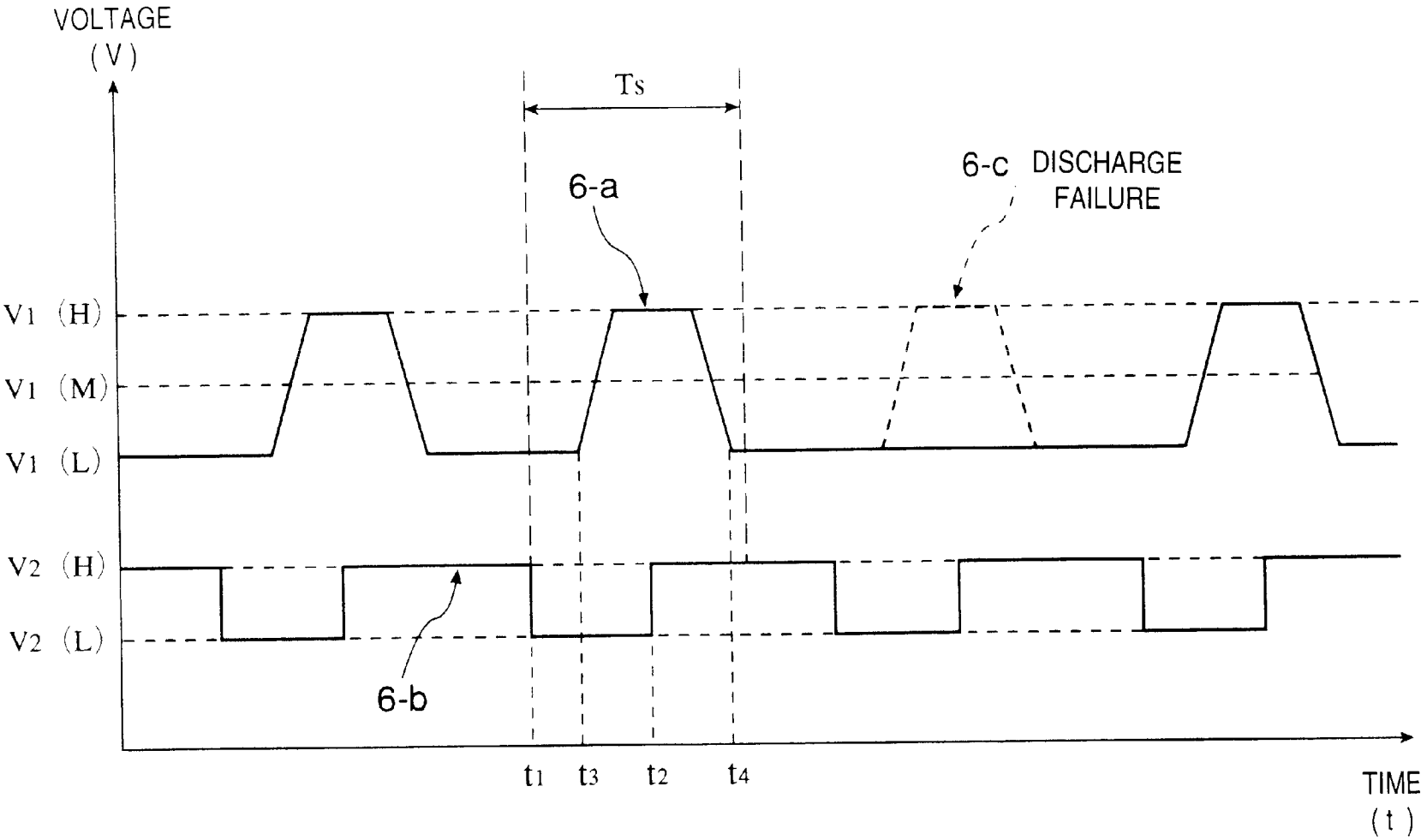
FIG. 9 is a timing chart showing the comparison between output from a linear encoder 72 and that from a photoreception device 82.

FIG. 9 is a timing chart showing the comparison between the output from a linear encoder 72 and that from the photoreception device 82. In FIG. 9, the horizontal axis represents time, and the vertical axis represents the output (voltage) from the linear encoder 72 and the photoreception device 82. Note that output 6*a* from the photoreception device 82 shows the output waveform of the signal corrected by the corrector 123.

In FIG. 9, at time t=t1, the linear encoder 72 outputs a signal, and the encoder output voltage changes from V2 (H) to V2(L), i.e., it is detected that the printhead 5 reaches a predetermined position. At this time, an ink droplet is discharged from a nozzle as the object of detection at the position. If the nozzle is normal, the ink droplet is discharged, and the ink droplet passes through the light flux of the light beam emitted from the light emitting device 81, thus the ink droplet blocks the light, accordingly, the waveform of the output from the photoreception device 82 changes from a voltage V1 (L) to a voltage V1(H) at time t=t3. At this time, if the output voltage exceeds a threshold value V1 (M), it is determined that the ink discharge has been performed, while if the output voltage does not exceed the threshold value, it is determined that ink discharge failed.

In this case, erroneous detection due to a noise signal upon light reception or the like can be prevented by sampling the output from the photoreception device 82, only during a predetermined period (Ts) from, e.g., the falling edge of the output from the linear encoder 72 (t=t1) (i.e., t=t1 to t4).

Note that in FIG. 9, numeral 6-c denotes a signal from the photoreception device 82 when ink discharge has not been performed.

The ink-discharge status detection using the above-described construction is performed in actual print operation in an appropriate timing, and it is controlled based on the result of detection to perform a predetermined operation such as recovery operation or complementary printing.

Next, various print controls based on the results of ink-discharge status detection will be described with reference to the flowcharts in FIGS. 10A and 10B and FIGS. 11A and 11B.

Figure 10A:
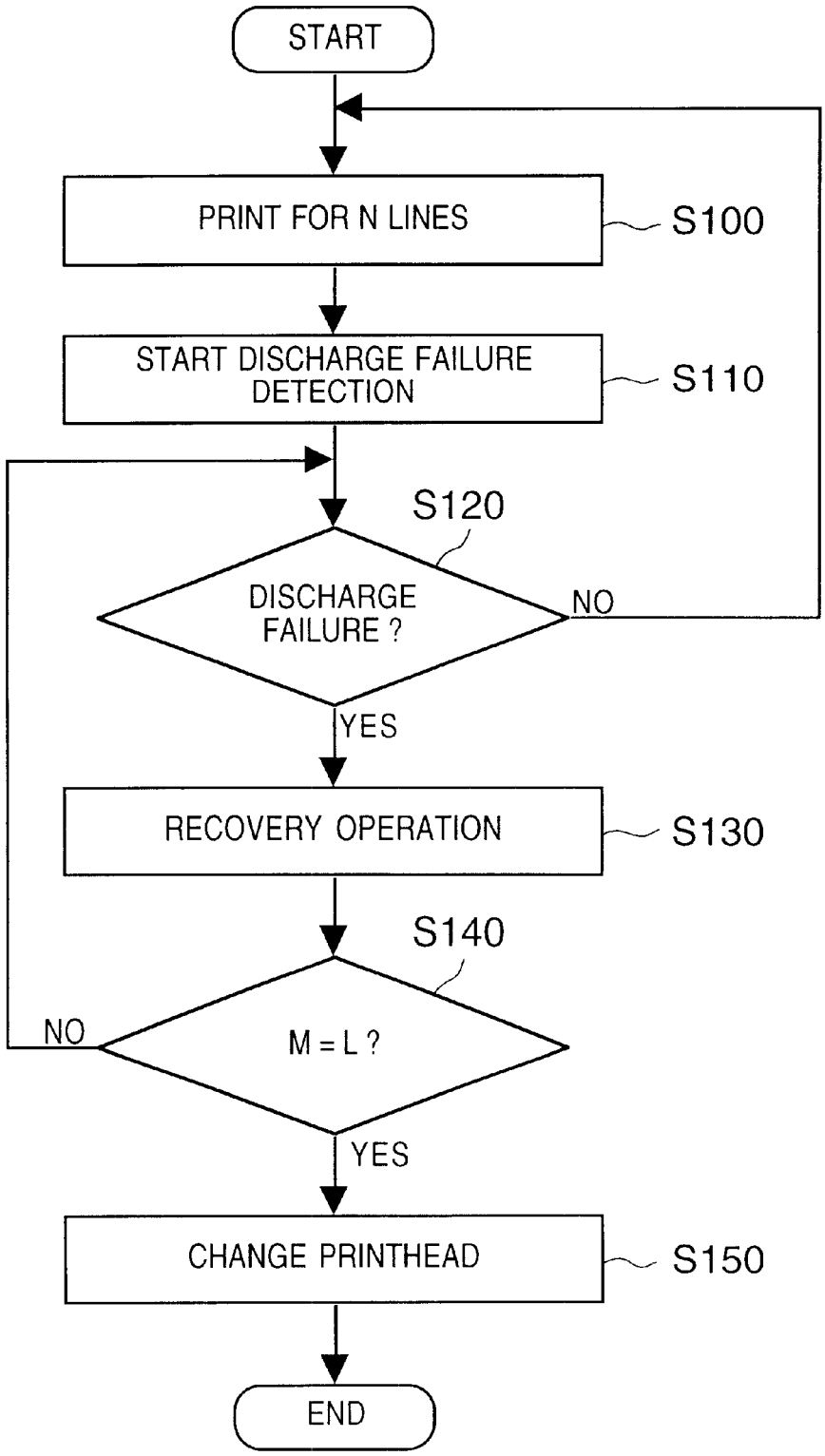
FIGS. 10A and 10B are flowcharts showing various print controls based on the results of ink-discharge status detection.

(1) Recovery Operation (FIG. 10A)

If it is detected that ink discharge from a nozzle has failed, the recovery operation is performed to recover the discharge function of the nozzle. The recovery operation includes normal ink pressurization/suction operations, cleaning of the ink discharge surface of the printhead (wiping, cleaning using liquid), preliminary discharge operation and the like. The printer selects an appropriate recovery operation in consideration of its processing capability, the processing speed, the economical factor (e.g. amount of waste ink) and the like. Note that these operations are well known and therefore detailed explanations of these operations will be omitted.

First, at step S100, the printhead 5 is scanned to perform print operation for N scannings. The value of N may be "1", otherwise, it may be any specific number satisfying N (positive integer)=1. Then, at step S110, test ink discharge is performed at the position of the photosensor 8 to examine whether or not each nozzle normally discharges ink.

Next, at step S120, it is examined whether or not the ink has been normally discharged from all the nozzles, based on the results of test ink discharge. If there is no defective nozzle in discharge failure status, the process returns to step S100, to continue normal print operation. On the other hand, if there is a defective nozzle in the discharge failure status, the process proceeds to step S130, to execute recovery operation.

Thereafter, the process proceeds to step S140 at which it is examined whether or not the accumulated number (M) of recovery operations has reached a predetermined number (L). If L<M holds, the process returns to step S120, while if L=M holds, it is determined that there is a defective nozzle unrecoverable from the discharge failure status, then the process proceeds to step S150 without performing the recovery operation. At step S150, the print operation is stopped, and a message advising the user to change the printhead is displayed on the LCD 59. At this time, if the unprinted portion where ink has not been discharged is inconspicuous in actual printing, the printing may be continued, or the ink cartridge may be exchanged.

Figure 10B:
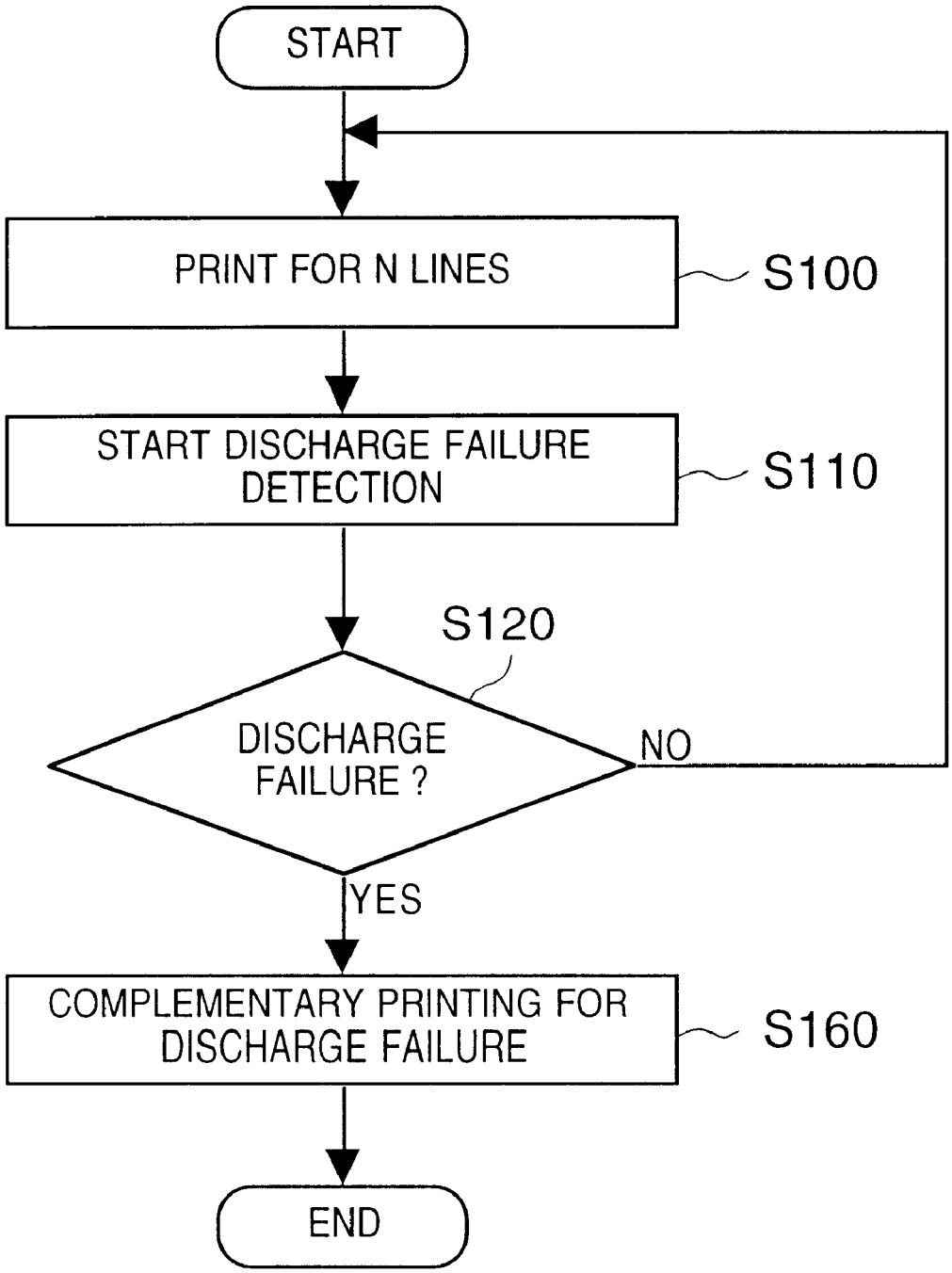

(2) Complementary Print Operation (FIG. 10B)

After the processing at steps S100 to S120, if it is determined that there is a defective nozzle in the discharge failure status, the process proceeds to step S160, at which print operation is performed such that an unprinted portion of a printed image where ink has not been discharged is complemented. The complementary printing is similar to that in the conventional technique, therefore, detailed explanation of the printing will be omitted.

Figure 11A:
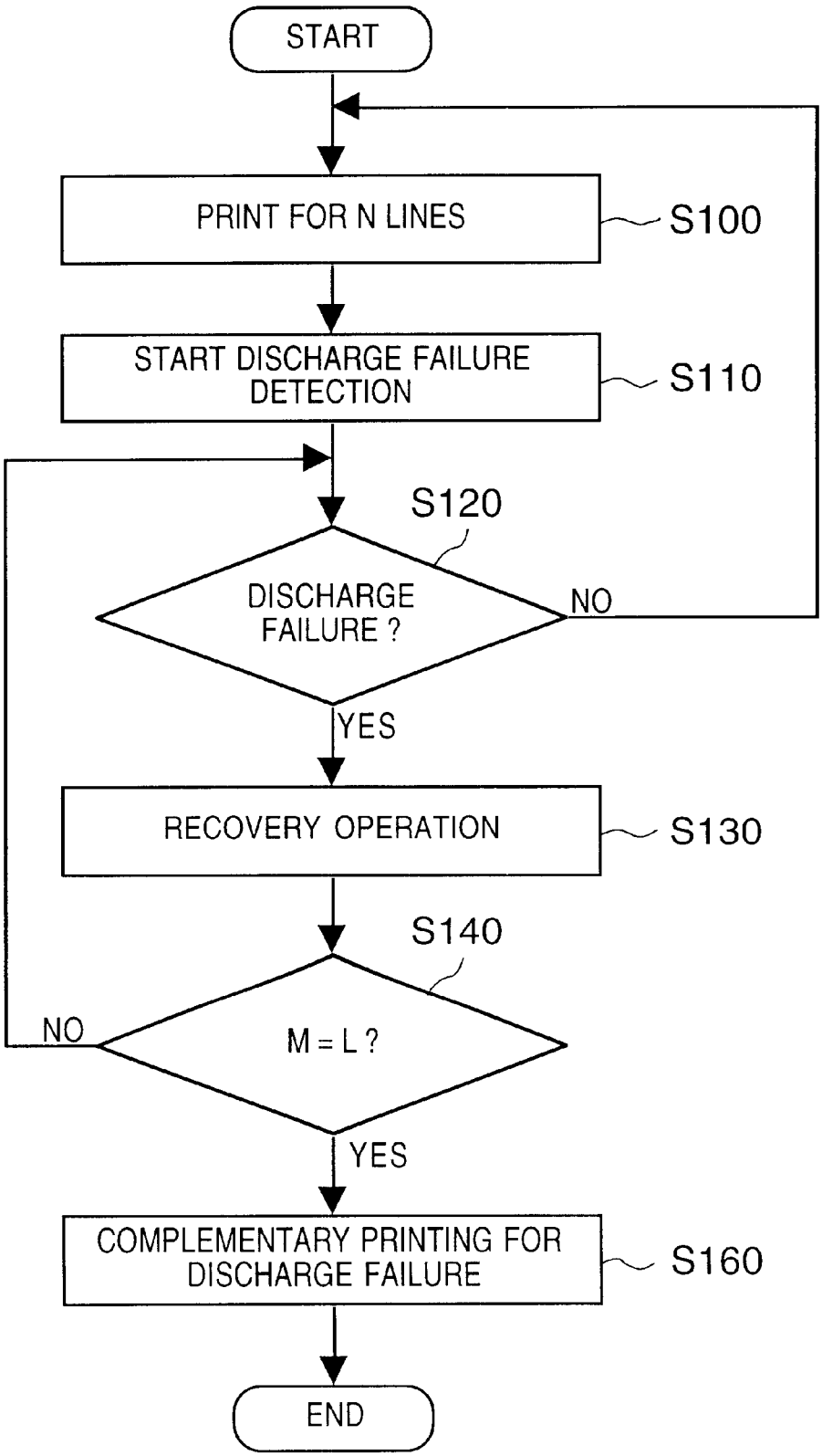
FIGS. 11A and 11B are flowcharts showing various print controls based on the results of ink-discharge status detection.

(3) Recovery Operation and Complementary Print Operation (FIG. 11A)

After the processing at steps S100 to S140, if it is determined that the accumulated number (M) of recovery operations has reached to the predetermined number (L), it is determined that there is a defective nozzle which cannot be recovered from discharge failure status. The process proceeds to step S160, at which the complementary print operation is performed.

Figure 11B:
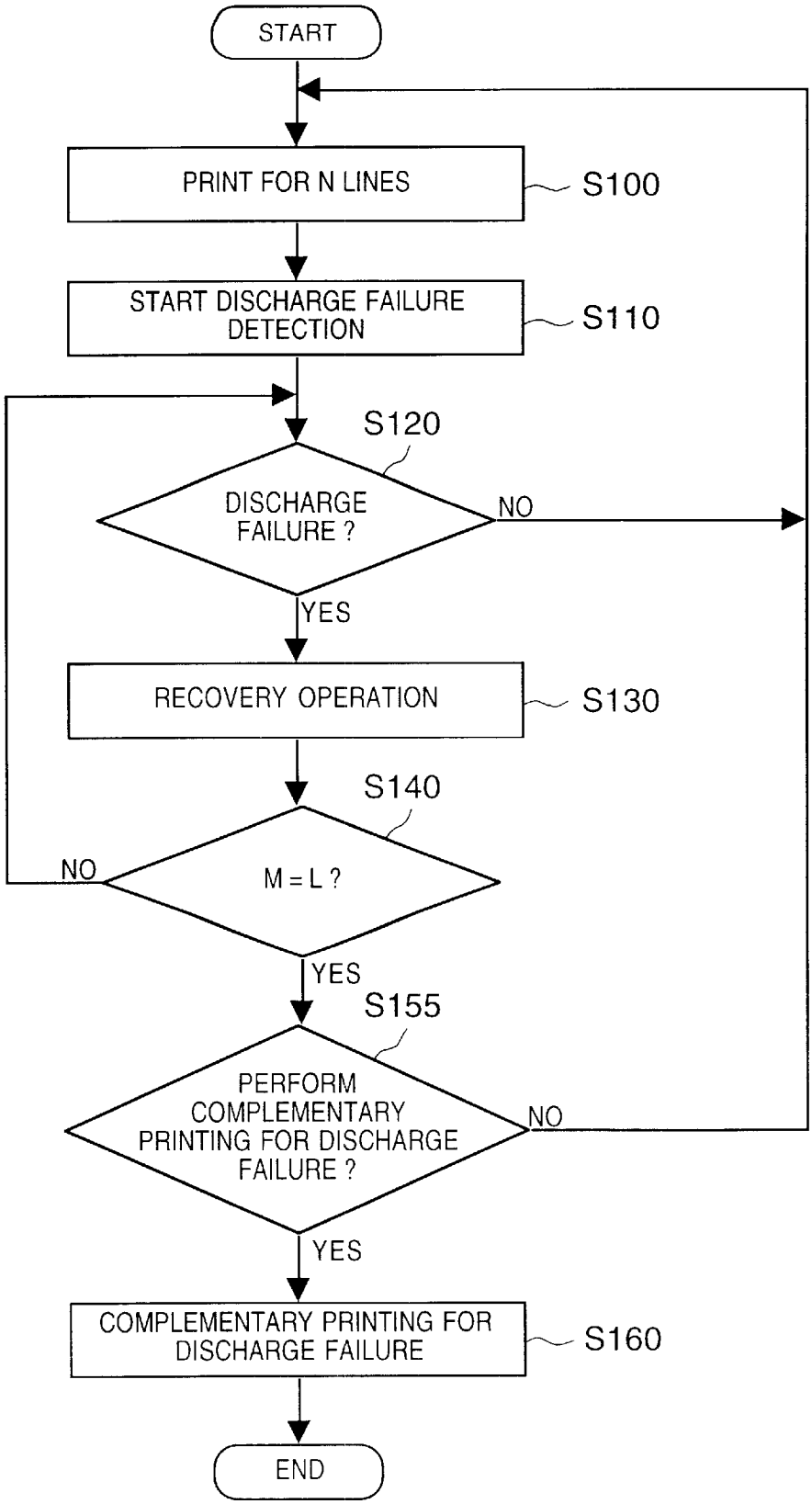

(4) Recovery Operation and Complementary Print Operation (FIG. 11B)

After the processing at steps S100 to S140, if it is determined that the accumulated number (M) of recovery operations has reached to the predetermined number (L), the process proceeds to step S155, to inquire of the user of the apparatus whether or not the user will perform the complementary printing. This inquiry may be made such that a message is displayed on the LCD 59 and an instruction from the operation panel 58 is waited, otherwise, a message is transmitted to the external computer 56 via the printer interface 54 and an instruction from the external computer 56 is waited.

If the user of the apparatus instructs execution of the complementary printing, the process proceeds to step S160 to perform the complementary printing. On the other hand, if the execution of the complementary printing is not instructed, the process returns to step S100 to perform the normal print operation.

By this arrangement, if there is a defective nozzle and its discharge function is not recovered, the user of the apparatus can select a final decision. For example, in actual image printing, if an unprinted portion is inconspicuous although ink has not been discharged, the user can determine not to perform the complementary printing, which causes a low printing speed, but to continue the normal printing so as to maintain the normal printing speed.

Accordingly, in accordance with the above-described embodiment, the result of detection of ink discharge status/discharge failure status for each nozzle can be processed in a realtime manner and sent to the CPU. Thus, the defective nozzle detection can be performed without reducing the printing speed.

Further, an appropriate print control (e.g. recovery operation, complementary printing, or printhead exchange) can be performed in accordance with the result of detection.

Note that in the above embodiment, the liquid droplets discharged from the printhead have been described as ink, and the liquid contained in the ink tank has been described as ink, however, the liquid is not limited to ink. For example, to increase fixability and water repellent capability of printed image, or to improve image quality, processing liquid or the like to be discharged to a print medium may be contained in the ink tank.

The embodiment described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision print operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of the so-called on-demand type or a continuous type. Particularly, in the case of the on-demand type, the system is effective because, by applying at least one driving signal, which corresponds to printing information and gives a rapid temperature rise exceeding film boiling, to each of electrothermal transducers arranged in correspondence with a sheet or liquid channels holding a liquid (ink), heat energy is generated by the electrothermal transducer to effect film boiling on the heat acting surface of the printhead, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printhead, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printhead having a length corresponding to the width of a maximum print medium which can be printed by the printer, either the arrangement which satisfies the full-line length by combining a plurality of printheads as disclosed in the above specification or the arrangement as a single printhead obtained by forming printheads integrally can be used.

In addition, an exchangeable chip type printhead which can be electrically connected to the apparatus main unit and can receive an ink from the apparatus main unit upon being mounted on the apparatus main unit or a cartridge type printhead in which an ink tank is integrally arranged on the printhead itself can be applicable to the present invention.

It is preferable to add recovery means for the printhead, preliminary auxiliary means, and the like provided as an arrangement of the printer of the present invention since the print operation can be further stabilized. Examples of such means include, for the printhead, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multicolor mode using a plurality of different colors or a full-color mode achieved by color mixing can be implemented in the printer either by using an integrated printhead or by combining a plurality of printheads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a print medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

In addition, the ink-jet printer of the present invention may be used in the form of a copying machine combined with a reader, and the like, or a facsimile apparatus having a transmission/reception function in addition to an image output terminal of an information processing equipment such as a computer.

The present invention can be applied to a system constituted by a plurality of devices (e.g., host computer, interface, reader, printer) or to an apparatus comprising a single device (e.g., copy machine, facsimile).

Further, the object of the present invention can be also achieved by providing a storage medium storing program codes for performing the aforesaid processes to a system or an apparatus, reading the program codes with a computer (e.g., CPU, MPU) of the system or apparatus from the storage medium, then executing the program.

In this case, the program codes read from the storage medium realize the functions according to the embodiment, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides aforesaid functions according to the above embodiment are realized by executing the program codes which are read by a computer, the present invention includes a case where an OS (operating system) or the like working on the computer performs a part or entire processes in accordance with designations of the program codes and realizes functions according to the above embodiment.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or entire process in accordance with designations of the program codes and realizes functions of the above embodiment.

As many apparently widely different embodiments of the present invention can be made without departing from the spirit and scope thereof, it is to be understood that the invention is not limited to the specific embodiments thereof except as defined in the appended claims.

What is claimed is:

1. A printing apparatus which performs printing by discharging ink onto a print medium by using a printhead having a plurality of printing elements arrayed in one line, said apparatus comprising:

scan means for reciprocate-scanning said printhead in a predetermined direction;

a photosensor, including a light emission device for emitting a light beam and a light reception device for receiving the light beam, provided in one end of a scanning path of said printhead, and arranged such that a light axis of the light beam between the light emission device and the light reception device intersects an arrayed direction of the plurality of printing elements of said printhead with a predetermined angle, for outputting a signal in accordance with interception status of the light beam;

test discharge means for controlling operation of said printhead to perform test ink discharge at a position where said photosensor is provided, while said scan means reciprocate-scans said printhead; and analysis means for analyzing existence or absence of ink discharge from each of said plurality of printing elements of said printhead, based on the signal outputted from said photosensor obtained at each of plural positions in the predetermined direction of said printhead when test-discharging ink by said test discharge means, wherein each of the plural positions is a position determined from correspondence of a position along the light axis of the light beam between the light emission device and the light reception device to a position of a printing element to be analyzed, wherein said analysis means includes specification means for specifying a printing element in discharge failure status among said plurality of printing elements of said printhead, based on the results of analysis by said analysis means.

2. The printing apparatus according to claim 1, further comprising a slit for limiting a light flux of said light beam entering the light reception device, in front of the light reception device.

3. The printing apparatus according to claim 1, further comprising encoder means for detecting a position of said printhead on the scanning path by said scan means.

4. The printing apparatus according to claim 3, wherein ink discharge timing by said test discharge means is based on position information outputted from said encoder means.

5. The printing apparatus according to claim 4, wherein each of said plurality of printing elements is specified by synchronizing said ink discharge timing with the signal outputted from said photosensor.

6. The printing apparatus according to claim 1, wherein said printhead has electrothermal transducers for generating thermal energy to be provided to ink, so as to discharge the ink by utilizing the thermal energy.

7. The printing apparatus according to claim 1, wherein said photosensor is provided outside an area occupied by the print medium in the scanning path of said printhead.

8. The printing apparatus according to claim 1, further comprising control means for performing print control based on the results of analysis by said analysis means.

9. The printing apparatus according to claim 8, further comprising recovery means for performing recovery operation on said printhead.

10. The printing apparatus according to claim 9, further comprising print means for performing print operation by driving said printhead upon forward scanning of said printhead by said scan means.

11. The printing apparatus according to claim 10, further comprising complementary printing means for performing complementary printing on a printed result by the printing element in the discharge failure status specified by said specification means, by using a printing element which normally operates, upon backward scanning of said printhead.

12. The printing apparatus according to claim 11, wherein said control means operates said specification means and said complementary printing means based on the results of analysis by said analysis means.

13. The printing apparatus according to claim 10, further comprising display means for displaying a message.

14. The printing apparatus according to claim 13, wherein if the printing element in the discharge failure status is not recovered from that status even when said control means has driven said recovery means to perform the recovery operation on the printing element a predetermined number of times, said control means controls said display means to display a message advising a user to change said printhead.

15. The printing apparatus according to claim 9, wherein said control means drives said recovery means based on the results of analysis by said analysis means.

16. A printing method of printing by reciprocally scanning a printhead which has a plurality of printing elements arrayed in one line and discharges ink on a printing medium, comprising the steps of:

starting to scan the printhead in a predetermined direction;

test-discharging ink to a light axis of a photosensor unit, including a light emission device for emitting a light beam and a light reception device for receiving the light beam, provided in one end of a scanning path of the printhead such that the light axis of the light beam between the light emission device and the light reception device intersects an arrayed direction of the plurality of printing elements of said printhead with a predetermined angle;

detecting an ink droplet test-discharged by the photosensor unit;

outputting a signal from the photosensor unit in accordance with interception status of the light beam; and analyzing existence or absence of ink discharge from each of said plurality of printing elements of said printhead, based on the signal outputted from said photosensor obtained at each of plural positions in the predetermined direction of said printhead when test-discharging ink, wherein each of the plural positions is a position determined from correspondence of a position along the light axis of the light beam between the light emission device and the light reception device to a position of a printing element to be analyzed, wherein said analyzing step includes specifying a printing element in discharge failure status among said plurality of printing elements of said printhead, based on the results of analysis at said analyzing step.

17. The method according to claim 16, further comprising the step of controlling a print operation during a period of scanning the printhead, based on the results of analysis at said analyzing step, wherein said controlling step performs control such that the printhead prints on the printing medium when scanning the printhead in the predetermined direction, while the printhead complementarily prints on a position, where a printing element was supposed to discharge an ink droplet but it is analyzed based on the analysis result that the printing element did not discharge, of the print medium when scanning the printhead in a direction opposite to the predetermined direction.

* * * * *